US010914059B1

(12) United States Patent
Payne

(10) Patent No.: US 10,914,059 B1
(45) Date of Patent: Feb. 9, 2021

(54) URINAL RAISED FOOTPLATE ASSEMBLY

(71) Applicant: Raymond S. Payne, St. Louis, MO (US)

(72) Inventor: Raymond S. Payne, St. Louis, MO (US)

( * ) Notice: Subject to any disclaimer, the term of this patent is extended or adjusted under 35 U.S.C. 154(b) by 0 days.

(21) Appl. No.: 16/682,680

(22) Filed: Nov. 13, 2019

(51) Int. Cl.
*E03D 13/00* (2006.01)
*A47K 17/02* (2006.01)

(52) U.S. Cl.
CPC ..... *E03D 13/005* (2013.01); *A47K 17/028* (2013.01)

(58) Field of Classification Search
CPC .... E03D 13/005; A47K 17/028; A47K 17/02; A47C 16/00; A47C 16/02; A47C 16/025
USPC ..... 4/254
See application file for complete search history.

(56) References Cited

U.S. PATENT DOCUMENTS 963,472 A 7/1910 Rowell
2,083,605 A * 6/1937 Jertberg ..... A47K 17/028 4/254
2,250,060 A * 7/1941 Finlay ..... A47K 17/028 4/254
2,851,697 A 9/1958 Dubay et al.
D260,425 S * 8/1981 Maciukiewicz ..... 4/254
4,713,846 A * 12/1987 Hodroski, Jr. ..... A47K 17/00 4/254
5,028,024 A * 7/1991 Welles ..... A47K 17/028 248/163.1
5,282,283 A * 2/1994 Atkin ..... A47K 17/00 4/301
5,920,926 A * 7/1999 Torres ..... A47C 16/02 4/574.1
6,571,399 B1 * 6/2003 Wagener ..... E03D 13/002 4/254
6,631,524 B1 * 10/2003 Dixon ..... A47C 16/025 297/423.45
7,904,972 B2 3/2011 Anderson
8,607,369 B1 * 12/2013 Al-Khattaf ..... A47K 17/02 4/254
8,616,652 B1 * 12/2013 Wells ..... A47C 16/025 297/423.39
D801,095 S * 10/2017 Konghe ..... D6/716
10,136,777 B2 11/2018 Naik
D841,995 S * 3/2019 Zioni ..... D6/353
10,253,488 B2 * 4/2019 Sikirov ..... E03D 11/025
(Continued)

FOREIGN PATENT DOCUMENTS

CN 202658698 U 1/2013
CN 203290840 U 11/2013
(Continued)

*Primary Examiner* — Benjamin R Shaw
(74) *Attorney, Agent, or Firm* — Grace J. Fishel

(57) ABSTRACT

A urinal raised footplate assembly with each of the footplates mounted on a weighted base and connected at the heel to a first transverse member for retaining the footplates at a fixed distance apart. The assembly further including axially extendable members connected to a second transverse member that when butted against a wall supporting the urinal maintains the footplates at a fixed distance from the urinal such that a user positioned on the footplates straddles a center of the urinal basin minimizing drips and protecting the footplate from spillage. Embodiments include flexible joints at the heel and toe such that the footplates may be angled to accommodate different width urinals.

10 Claims, 7 Drawing Sheets

(56) References Cited

U.S. PATENT DOCUMENTS

| | | | | |
|---|---|---|---|---|
| 2012/0169106 | A1* | 7/2012 | Alkhattaf | A47C 16/02 297/423.41 |
| 2014/0007333 | A1* | 1/2014 | DeFlorio | A47K 17/02 4/254 |
| 2016/0051101 | A1* | 2/2016 | Long | E03D 13/005 4/251.1 |
| 2016/0360937 | A1* | 12/2016 | Naik | A45D 34/02 |
| 2018/0168412 | A1* | 6/2018 | Pham | A47C 16/025 |
| 2018/0325337 | A1* | 11/2018 | Kim | A47K 17/02 |
| 2018/0325338 | A1 | 11/2018 | Al-Khattaf | |
| 2020/0268222 | A1* | 8/2020 | Loutos, II | A47K 17/026 |

FOREIGN PATENT DOCUMENTS

| | | | |
|---|---|---|---|
| CN | 205116355 | U | 3/2016 |
| CN | 207776051 | U | 8/2018 |
| DE | 10143081 | A1 | 5/2002 |
| FR | 0761119 | | 3/1934 |
| FR | 0839936 | | 4/1939 |
| GB | 194236 | A | 3/1923 |
| GB | 2478551 | A | 9/2011 |
| JP | 2003024247 | A | 1/2003 |
| JP | 2004254852 | A | 9/2004 |
| JP | 2009279121 | A | 12/2009 |
| KR | 100999079 | B1 | 12/2010 |
| KR | 101341714 | B1 | 12/2013 |

* cited by examiner

URINAL RAISED FOOTPLATE ASSEMBLY

BACKGROUND OF THE INVENTION

Field of the Invention

The present invention relates to a urinal raised footplate assembly which assures a urine-free stance in front of a urinal.

Brief Description of the Prior Art

The universal experience for men when using a urinal in a public restroom is to encounter splatters or a pool of urine on the floor in front of the urinal that one must inevitably step in with their shoes in order to properly use the urinal. These urine-soiled shoes then make their way back to the office and eventually back home. This is a little publicized sanitary nightmare that is crying out for a solution.

The above problem has not escaped the attention of the inventive community and there are many proposed solutions which fall short for a variety of reasons.

Many assume that correct positioning can be achieved that will totally eliminate spillage of urine. This is a fallacy for a variety of reasons. One example is that men may think they have the correct positioning, but they don't because they cannot see over their large bellies in order to verify their position. Another example is the inadvertent last spurt of urine that may surprise one after they have pulled away from the urinal—particularly in older gentleman. It is better to assume spillage will occur when trying to address the issue of a clean spot to place one's feet.

Others provide a grill of some sort underfoot that is purported to minimize the contact of the bottom of the shoe with soiled flooring. These solutions will not support the principle of 'where the foot is placed, the footplate will be protected from spillage' as the user has the option to place his foot anywhere. Even though there is a grill which will minimize contact with urine, the bottom of the foot will still come in contact with urine if not guided to protect the same place for every use. Additionally, these solutions are not standalone and require plumbing renovation and are not easily leverageable to the installed base of urinals.

Others propose some sort of less elevated, non-adjustable ribbed or non-ribbed footpad or foot mat. These are generally not sufficiently raised off the floor to eliminate foot contamination from spillage or to prohibit the user from placing his feet elsewhere which then would compromise the cleanliness of all foot placement areas. Additionally, the fact that they are not adjustable is a convenience drawback from the standpoint of not being able to customize the footplate stance relative to the unique design of a urinal.

BRIEF SUMMARY OF THE INVENTION

In view of the above, it is a primary object of the present invention to provide a urinal raised footplate assembly that assures a urine-free stance in front of a urinal such that one's shoes stay dry and urine is not tracked into other areas. It is another object to provide an assembly that is adjustable to conform to the unique lengths and contours of various urinal styles and to provide the user a more comfortable stance lessening the likelihood of spillage. Other objects and features of the invention will be in part apparent and in part pointed out hereinafter.

Broadly stated, the present invention relates to a urinal raised footplate assembly which assures a urine-free stance in front of a urinal. In addition to supporting a user's feet out of the urine, the assembly is adjustable to conform to the unique lengths and contours of a urinal and provides the user a more comfortable stance lessening the likelihood of spillage. By its very nature the assembly causes all users to stand in the same spot thus supporting the key principle for assuring a urine-free stance: 'where the foot is placed, the footplate will be protected from spillage'. In addition, the urinal raised footplate is portable and easily raised off the floor for cleaning any urine spillage that might occur. The fact that the assembly is standalone makes it easily leveraged with the vast installed base of urinals. The assembly optionally has underlighting to encourage care while urinating or to provide novelty for special occasions and parties.

More particularly, in accordance with the invention, a urinal raised footplate assembly has first and second raised footplates, each of which are connected at a heel to a first transverse member for spacing the footplates a selected distance apart. The first and second footplates are connected at a toe to axially extendable members which in turn are connected to a second transverse member for maintaining the footplates at the selected distance apart and spaced a proper distance from a center front edge of the urinal basin.

In another aspect, the raised footplates are mounted on a weighted base and the axially extendable members have telescoping sections with a spring biased pin for locking the member in a selected position. The weighted base discourages users from moving the assembly out of operative position. In some implementations, a skirt is attached to an inboard side of the footplates for deflecting any dripped or splashes urine.

To accommodate different width urinals, flexible joints are provided at the heel and toe of the footplates for attachment to the first transverse member and to the axially extendable members. In this embodiment the second transverse member is also extendable to accommodate angling of the footplates outwardly. Various flexible joints are contemplated including a ball joint, pivot hinge, clevis joints and so forth.

The invention summarized above comprises the constructions hereinafter described, the scope of the invention being indicated by the subjoined claims.

BRIEF DESCRIPTION OF THE SEVERAL VIEWS OF THE DRAWINGS

In the accompanying drawings, in which several of various possible embodiments of the invention are illustrated, corresponding reference characters refer to corresponding parts throughout the several views of the drawings in which.

DETAILED DESCRIPTION OF AT LEAST ONE PREFERRED EMBODIMENT OF THE INVENTION

Figure 1:
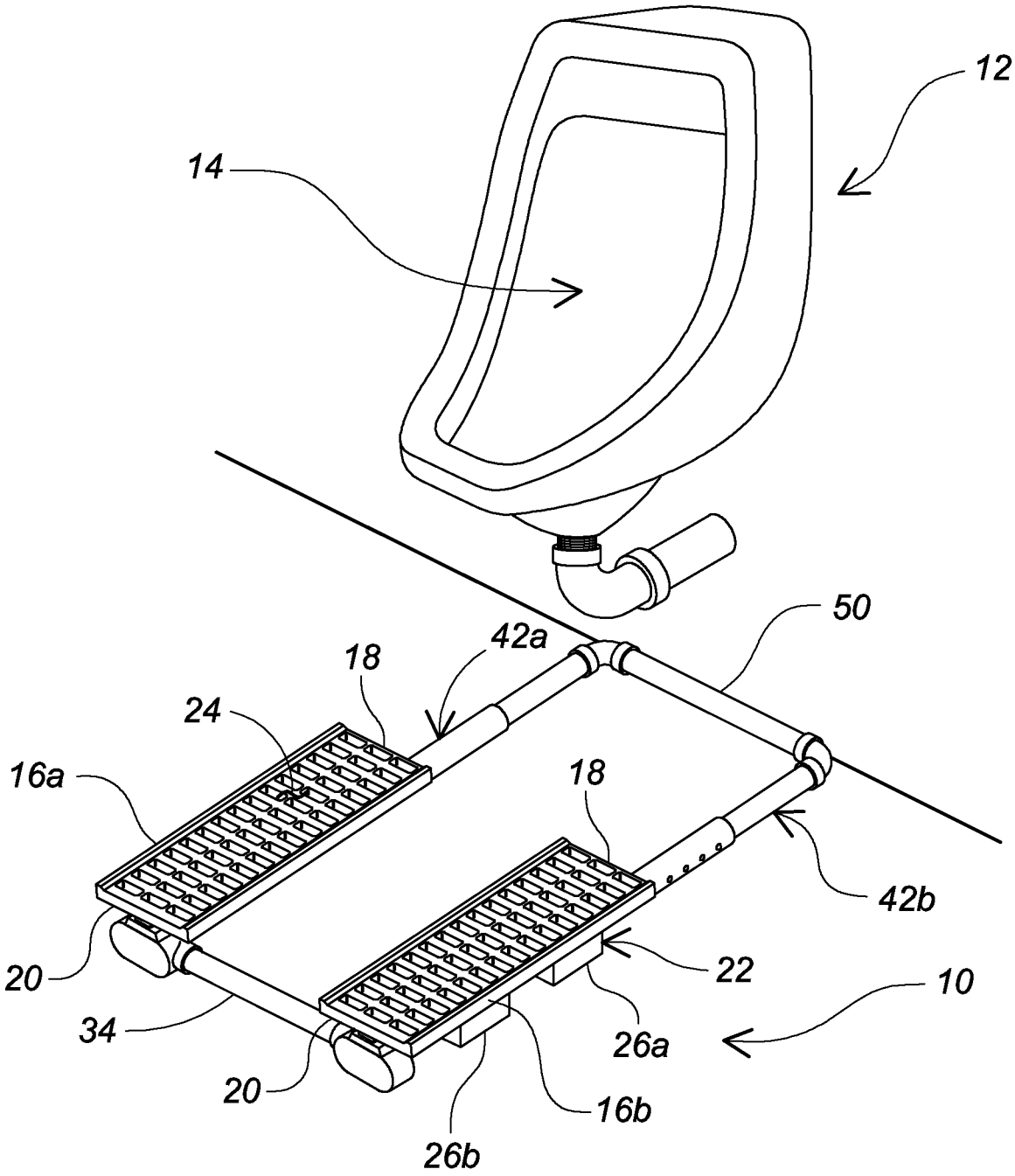
FIG. 1 is perspective view of a urinal raised footplate assembly in accordance with the present invention shown on the floor butted against a wall on which a urinal is attached.
Figure 2:
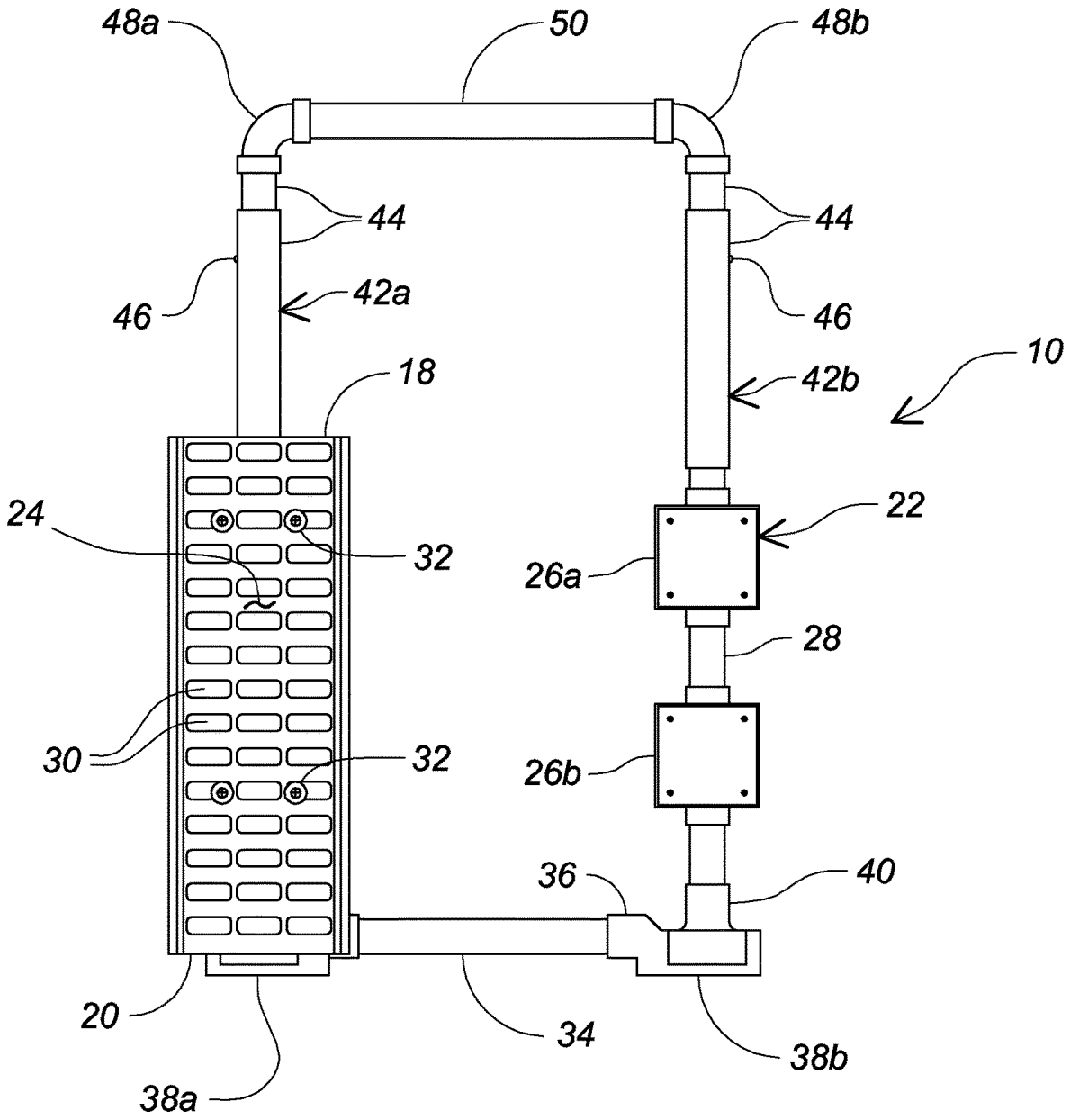
FIG. 2 is a plan view of the assembly with a right footplate removed to show a support base.
Figure 3:
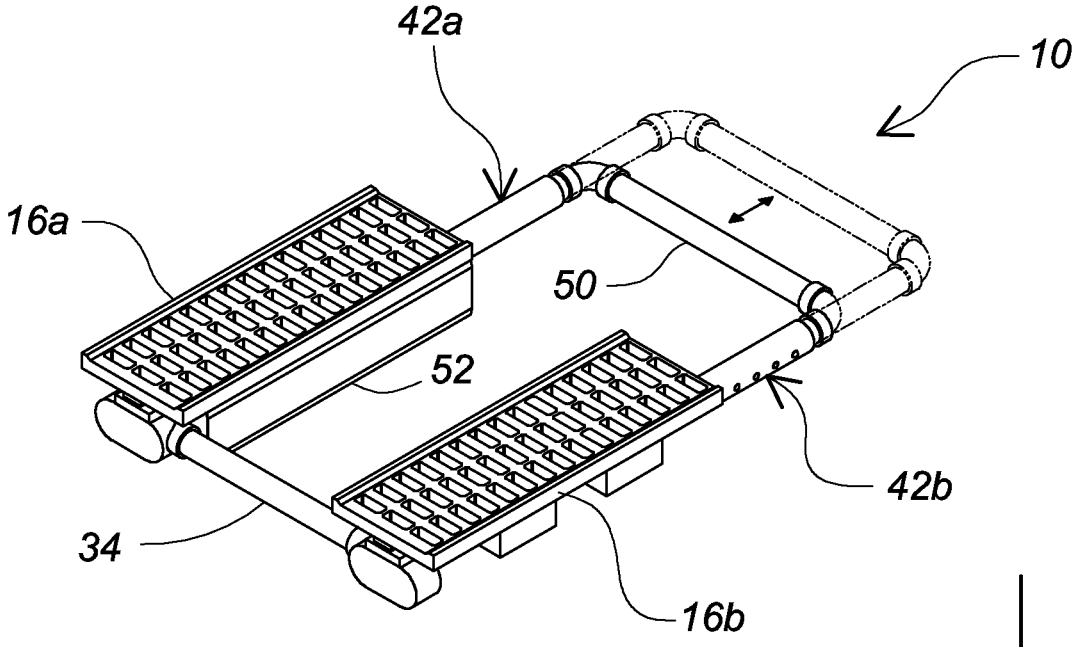
FIG. 3 is a perspective view showing axial adjustability with telescoping members.

Referring to the drawings more particularly by reference character, reference numeral 10 refers to a urinal raised footplate assembly in accordance with the present invention. Assembly 10 is an accessory provided on the floor adjacent to a urination fixture (i.e., a toilet or a urinal 12) for use in public restrooms although the assembly may be used in private homes also. Urinals 12 in public restroom are typically positioned against a wall with a basin 14 that may be either raised or sit on the floor. Turning first to FIGS. 1-4, a first embodiment of assembly 10 includes a pair of footplates 16*a*, 16*b*. Each of footplates 16*a*, 16*b* has a toe portion 18 that in use faces in the direction of urinal 12 and a heel portion 20 that is positioned away from the urinal. The size of footplates 16*a*, 16*b* is such that an average shoe can comfortably fit on top thereof. Each of footplates 16*a*, 16*b* is mounted on a support base 22 such that a top surface 24 of the footplate is elevated above any urine that may pool on the floor between the footplates.

Satisfactory footplates 16*a*, 16*b* in some embodiments have a raised floor height of about 2 to 3 inches, a length "l" of about 15 inches with a width "w" of about 5 inches. Footplates 16*a*, 16*b* may be integrally formed with bases 22 or provided as separate elements. As shown in FIGS. 1-4 each of bases 22 includes first and second blocks 26*a*, 26*b*, respectively, connected with a piece of tubular material such as conduit 28. Blocks 26*a*, 26*b* may be filled with concrete or the like and footplates 16*a*, 16*b* may be perforated 30 and bolted 32 to bases 22. In the form illustrated, perforations 30 are rectangular and set in a straight pattern but other patterns such as rectangular staggered, round, oblong and the like may be used to suit aesthetic tastes. Also footplates 16*a*, 16*b* may have no perforations at all. Rubber pads or other slip resistant materials (not shown) may be provided on a bottom surface of bases 22 to further keep assembly 10 from being easily displaced from operative position by the users.

Footplates 16*a*, 16*b* are joined at heel 20 with a first transverse member 34 spacing the footplates at a selected distance apart. In the form illustrated, first transverse member 34 is a length of tubular material such as conduit received in an arm 36 of opposing right angle connectors 38*a*, 38*b*. The other arm 40 of each connector 38*a*, 38*b* is connected to block 26*b* of base 22, optionally illustrated by a length of tubular materials such as conduit.

Footplates 16*a*, 16*b* are joined at toe 18 with axially extendable members 42*a*, 42*b*, respectively for positioning the footplates a selected distance from the wall under urinal 12. In the form illustrated, each of axially extendable members 42*a*, 42*b* are composed of two or more telescoping sections 44 such as conduit which may be fixed in a selected extended position with a spring biased pin 46. Distal of footplates 16*a*, 16*b* right angle couplings 48*a*, 48*b* connect axially extendable members 42*a*, 42*b* with a second transverse member 50.

In an embodiment of assembly 10, the inboard spacing between footplates 16*a*, 16*b* is eight inches and first and second transverse members 34, 50 are spaced about 23 inches apart adjustable to 25 with axially extendable members 42*a*, 42*b*. It will be understood that these measurements are representative, not binding. When placed properly in front of urinal 12, assembly 10 will encourage the user to mount the footplates 16*a*, 16*b*. Placement of the user's feet either inside or outside of the footplates would be either impossible or sufficiently awkward to preclude the ability to urinate. Placement of the feet behind the rear transverse member 34 would also preclude proper positioning for urination.

Figure 7:
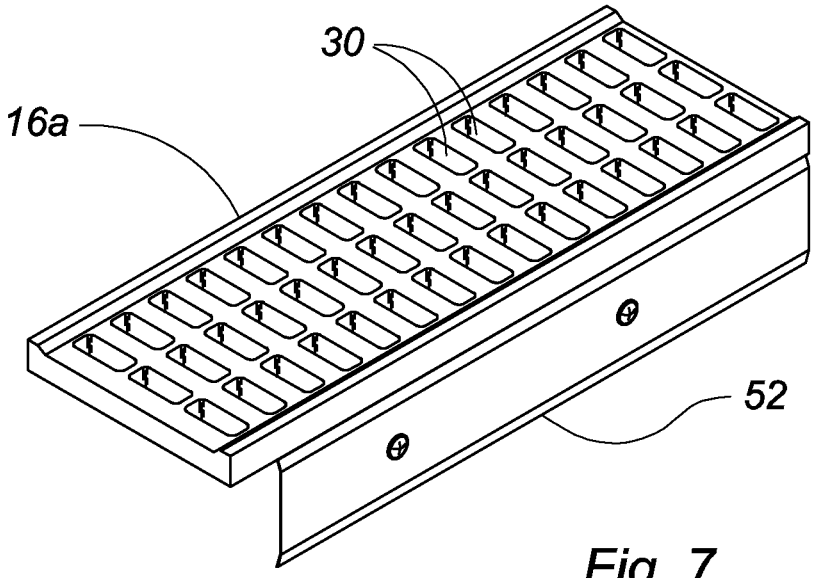
FIG. 7 is a perspective view of a footplate with a skirt attached on an inboard side.
Figure 8:
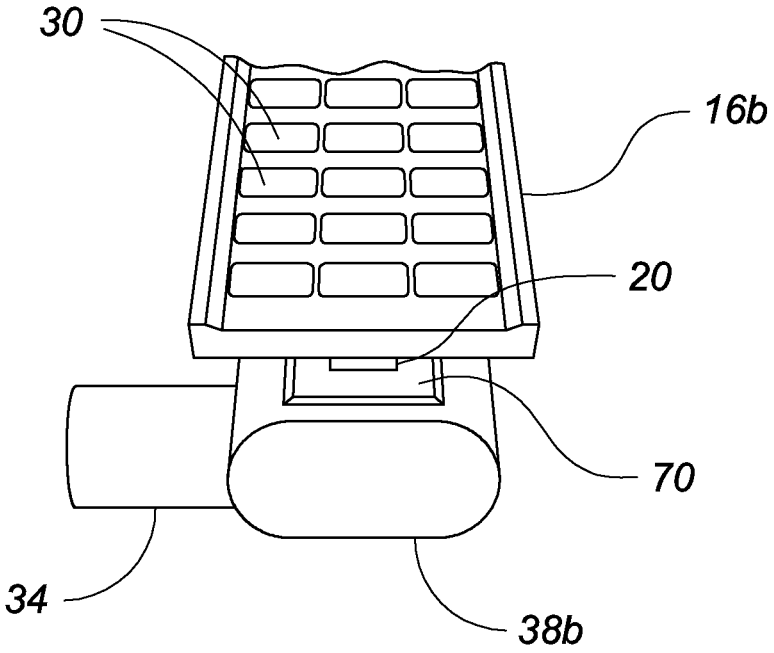
FIG. 8 is a detail showing a flat on a right angle connector under the heel of the footplate to prevent rocking.

Thus assembly 10 in use provides an obstacle that encourages the user to stand on footplates 16*a*, 16*b* straddling a center front edge of basin 14 thus minimizing the amount of spillage. Some urine, however, inevitably will not make it into the basin or will splash out of the basin onto the floor. A skirt 52 as shown in FIG. 7 may be provided on the inboard side of footplates 16*a*, 16*b* to redirect any drips and splashes towards the floor between the footplates. By standing on elevated footplates 16*a*, 16*b* the bottom of user's shoes are kept dry and urine is not tracked out of the restroom into other areas. Additionally, any spillage that might occur during urination will never reach the footplate as the user's foot will always be protecting it. The spillage could conceivably reach the top of the foot but never the covered footplate below. Thus the key objective of this invention is achieved: providing a urine-free stance.

Figure 4:
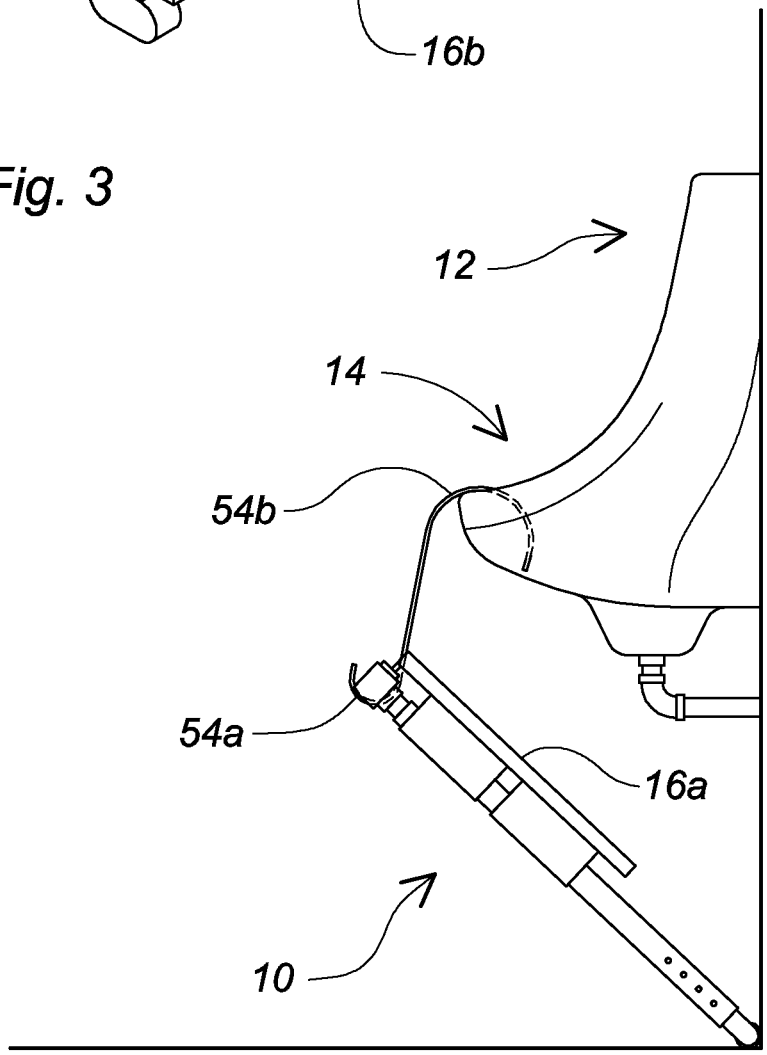
FIG. 4 shows a manner in which the assembly may be hung from the urinal to facilitate cleaning of the floor.

With second transverse member 50 butted against the wall of urinal 12, assembly 10 is prevented from sliding forward in use and when installed in front of the urinal is not easily willfully displaced to the side or back by users when base 22 has skid resistant pads and is weighted. On the other hand, ordinary maintenance of the restroom including mopping of the floor is not inhibited. As shown in FIG. 4, a handle with hooks 54*a*, 54*b* on opposite ends may be used to lift assembly 10 by transverse member 34 and attach the assembly to the front lip of urinal 12 such that the floor under assembly may be mopped.

Figure 5:
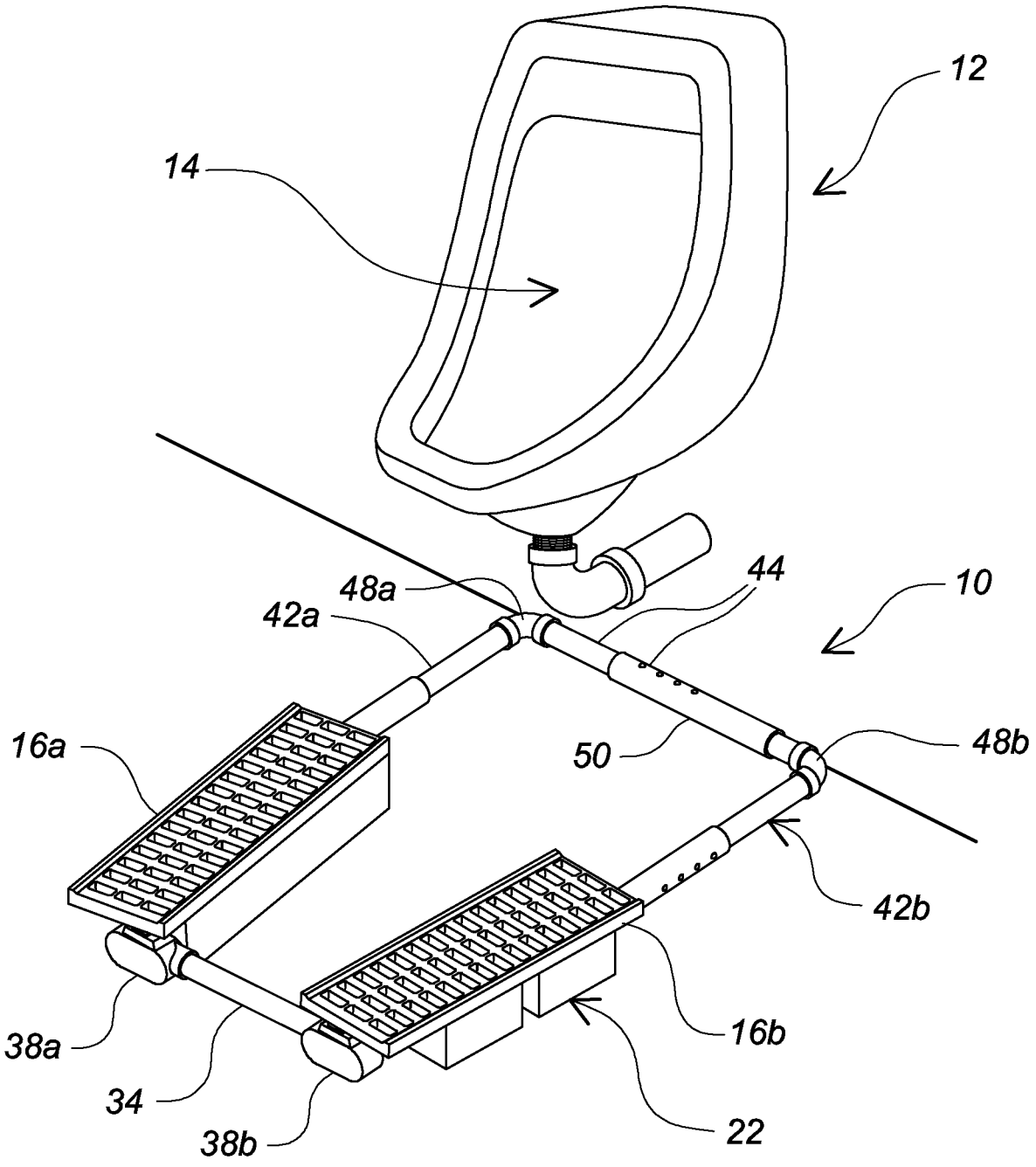
FIG. 5 is a perspective of an embodiment of the urinal raised footplate assembly laterally adjustable to accommodate wider urinals and a more comfortable "V" stance.
Figure 6:
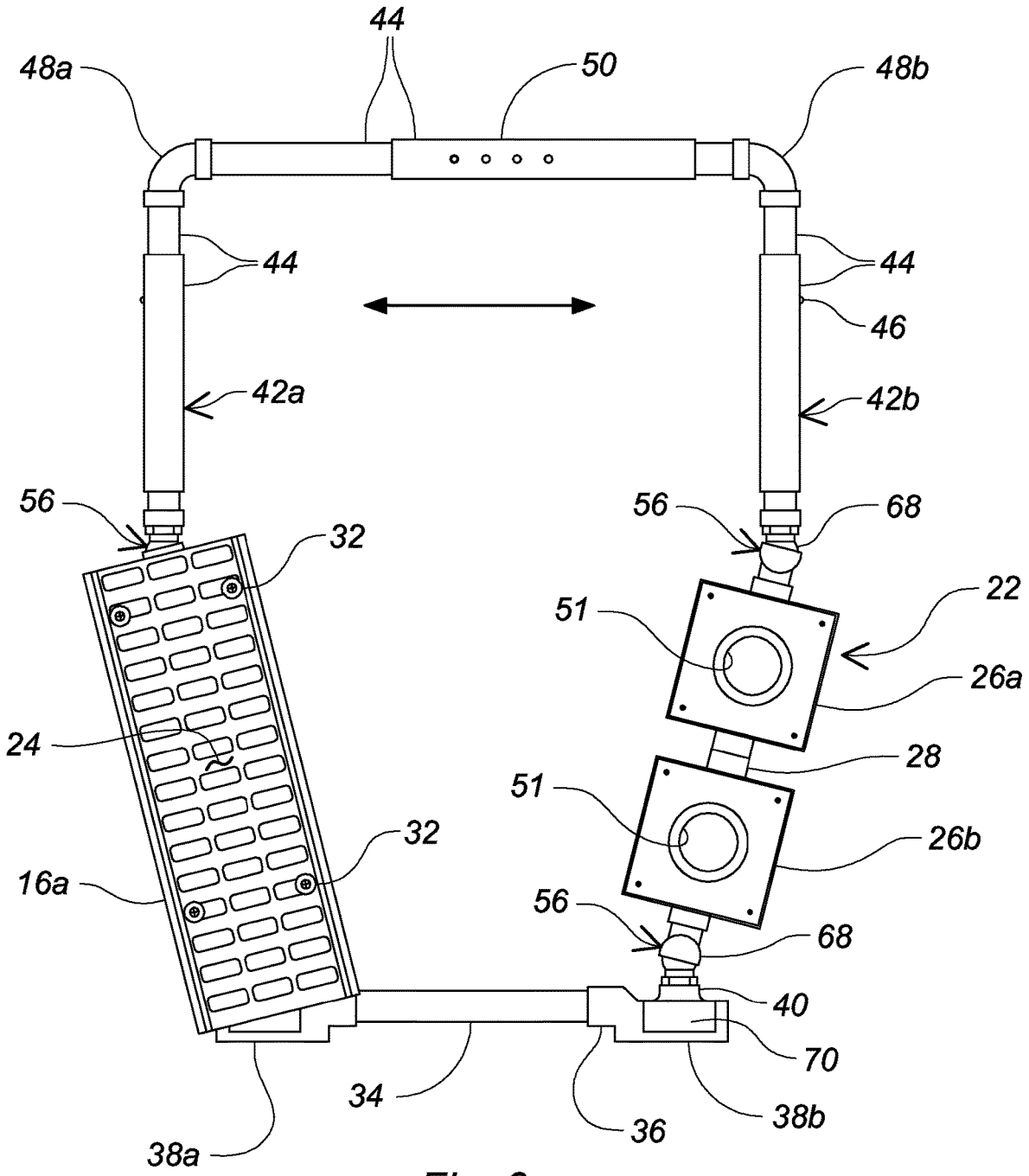
FIG. 6 is a plan view of the assembly shown in FIG. 5 with the right foot plate removed to show a support base with lights.

Not all urinals 12 have the same width. Other embodiments of assembly 10 as shown in FIGS. 5-6 address this problem by allowing footplates 16*a*, 16*b* to be angled outward at the top. This facilitates the adjustment of the footplate position to conform to the varying widths and angled contours of urinals. To this end, a flexible joint 56 may be provided between opposing right angle connectors 38*a*, 38*b* and footplates 16*a*, 16*b* at heel 20 and a second flexible joint 56 may be provided between footplates 16*a*, 16*b* at toe 18 and axially extendable members 42*a*, 42*b*. To accommodate this movement, second transverse member 50 is made axially extendable with telescopic sections 44 that may be locked with a spring biased pin 46. Also has shown in FIG. 5, weighted base 22 may include a center cavity 51 into which an electric light may be fitted to attract the attention of the user to the footplate and to encourage care while urinating. Optionally, multi-colored underlighting with remote control featuring flash, fade, cycle through colors could be used as a novelty during special occasions and parties.

Figure 9:
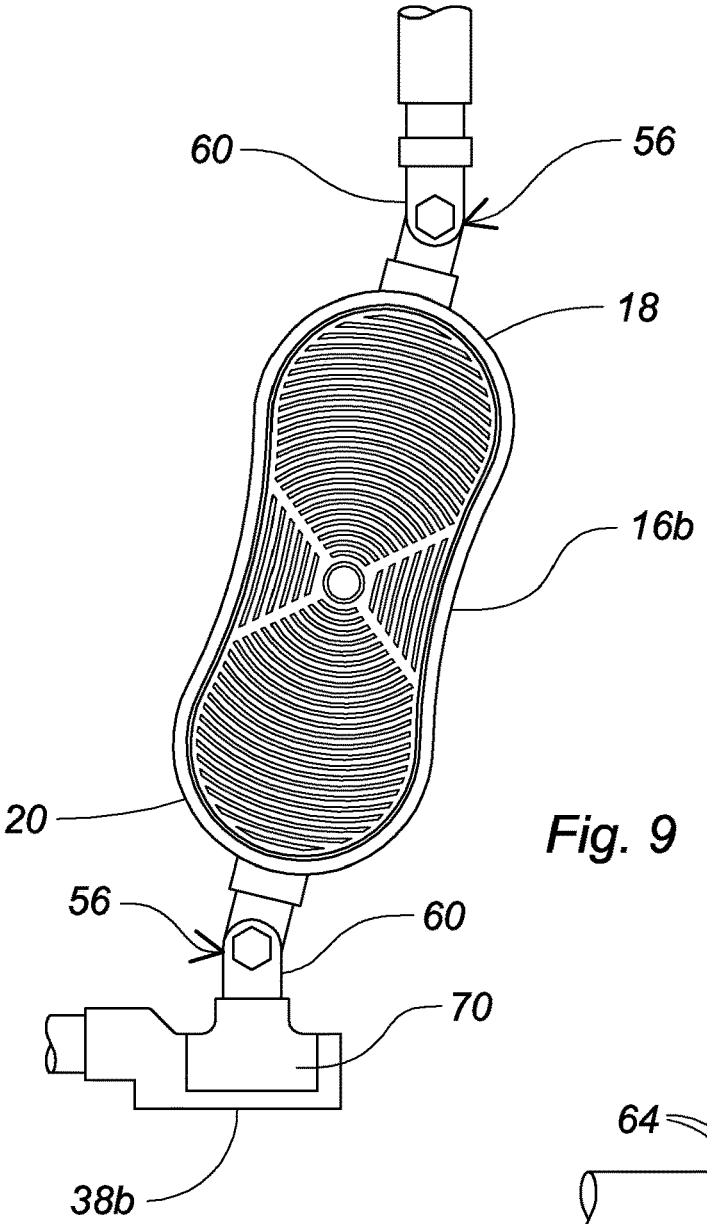
FIG. 9 shows further embodiment of the assembly with an ergonomically shaped footplate and a clevis joint.
Figure 10:
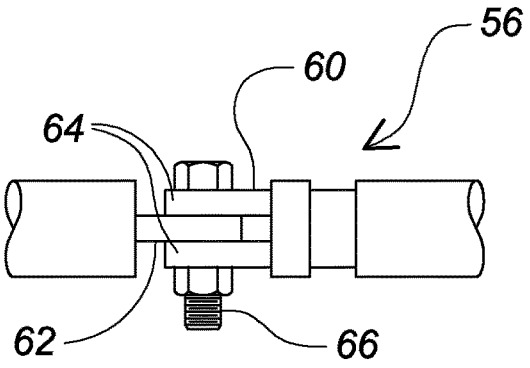
FIG. 10 is a detail of the clevis joint.
Figure 11:
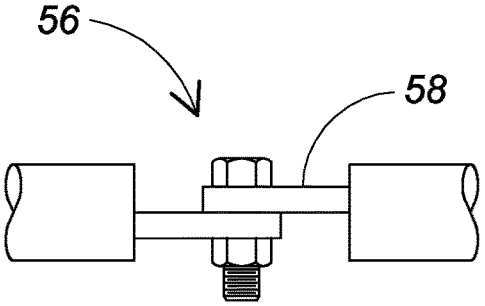
FIG. 11 is a hinge joint which may be used in place of the ball joints shown in FIGS. 1-6 and clevis joint shown in FIGS. 9-10.

Each or both of flexible Joints 56 may be a pivot hinge 58 as shown in FIG. 11 or a clevis joint 60 as shown in FIGS. 9-10. Pivot hinge 58 is simple but fragile and for that reason clevis joint 60 may be preferred where a mating component 62 fits between forks 64 and is held in place with a clevis pin 66. Pivot hinge 58 and clevis joint 60 allow deflection in one plane only. For more flexibility, which may facilitate placement of assembly 10 on an uneven floor or the like, one or both flexible joints 56 may be a ball joint 68 as shown in FIGS. 1-4, universal joint, etc. When flexible joints 56 are ball joints 68 a flat 70 may be provided on opposing right angle connectors 38*a*, 38*b* as an abutment shoulder under heel 20 to prevent footplates 16*a*, 16*b* from rocking on base 22.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A urinal raised footplate assembly comprising first and second raised footplates, each of said footplates connected at a heel of the footplate to a first transverse member for spacing the footplates a selected distance apart, said first footplate connected at a toe of the footplate to an axially extendable first member and said second footplate connected at a toe of the footplate to an axially extendable second member, said first and second axially extendable members connected to a second transverse member for maintaining the footplates at the selected distance apart.

2. The assembly of claim 1 wherein each of the first and second footplates are mounted on a weighted base and each of the first and second axially extendable members have telescoping sections with a spring biased pin for locking the member in a selected position.

3. The assembly of claim 2 wherein each of the first and second footplates has a skirt attached to an inboard side for deflecting dripped or splashed urine.

4. A urinal raised footplate assembly comprising first and second raised footplates, each of said footplates mounted on a weighted base, each of said footplates connected with a first flexible joint at a heel of the footplate to a fixed transverse member for spacing the footplates a first selected distance apart, said first footplate connected with a second flexible joint at a toe of the footplate to an axially extendable first member and said second footplate connected at a toe of the footplate with a second flexible joint to an axially extendable second member, said first and second axially extendable members connected to an extendable transverse member for spacing the footplates at a second selected distance apart.

5. The assembly claim 4 wherein the first and second axially extendable members have telescopic sections with a spring biased pin for locking the sections at a selected extended length.

6. The assembly of claim 4 wherein the first and second footplates are perforated and the base includes a cavity for a light.

7. The assembly of claim 4 wherein one or more of the first and second flexible joints are a hinge, clevis joint or a ball joint.

8. A urinal raised footplate assembly comprising first and second raised footplates, each of said footplates bolted to a weighted base with a skirt on an inboard side, each of said footplates connected with a first flexible joint at a heel of the footplate to a fixed transverse member for spacing the footplates a first selected distance apart, said first footplate connected with a second flexible joint at a toe of the footplate to an axially extendable first member and said second footplate connected at a toe of the footplate with a second flexible joint to an axially extendable second member, said first and second axially extendable members connected to an extendable transverse member for spacing the footplates at a second selected distance apart.

9. The assembly of claim 8 wherein the first and second flexible joints are ball joints.

10. The assembly of claim 9 wherein the first flexible joint connected to the heel of each of the first and second footplates is connected to the first fixed transverse member by right angle couplings having a flat forming a shoulder under the heel of the first and second footplates to prevent rocking of the first and second footplates.

* * * * *